US009959791B2

(12) United States Patent
Fuller et al.

(10) Patent No.: US 9,959,791 B2
(45) Date of Patent: May 1, 2018

(54) WATER DISPLAYS INCLUDING CHANGING POOLS

(71) Applicant: WET, Sun Valley, CA (US)

(72) Inventors: Mark Fuller, Sun Valley, CA (US); Dave Duplanty, Sun Valley, CA (US); Bill DeLeon, Sun Valley, CA (US); Claire Tuttle, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days. days.

(21) Appl. No.: 14/134,954

(22) Filed: Dec. 19, 2013

(65) Prior Publication Data

US 2014/0202052 A1 Jul. 24, 2014

Related U.S. Application Data

(60) Provisional application No. 61/739,295, filed on Dec. 19, 2012.

(51) Int. Cl.

| | |
|---|---|
| ***G09F 19/00*** | (2006.01) |
| ***G09F 19/02*** | (2006.01) |
| ***B05B 17/08*** | (2006.01) |

(52) U.S. Cl.

CPC ..... *G09F 19/02* (2013.01); *B05B 17/08* (2013.01)

(58) Field of Classification Search

USPC ..... 40/406; 52/169.7, 311.1; 239/16, 17; 4/506–509, 513

See application file for complete search history.

(56) References Cited

U.S. PATENT DOCUMENTS

| | | | | |
|---|---|---|---|---|
| 4,094,464 | A | 6/1978 | Kawamura et al. | |
| 4,290,241 | A * | 9/1981 | Tucker | A47K 3/02 217/76 |
| 4,466,141 | A * | 8/1984 | Starkey | 4/488 |
| 5,216,976 | A | 6/1993 | Marinkovich | |
| 5,553,779 | A | 9/1996 | Fuller et al. | |
| 6,381,768 | B1 * | 5/2002 | Herman | 4/541.1 |
| 8,112,951 | B2 * | 2/2012 | Gravel | 52/182 |
| 2007/0245480 | A1 * | 10/2007 | Sorensen et al. | 4/509 |

FOREIGN PATENT DOCUMENTS

| | | |
|---|---|---|
| JP | H 03-249969 A | 11/1991 |
| KR | 10-0887689 B1 | 3/2009 |

* cited by examiner

*Primary Examiner* — Joanne Silbermann
(74) *Attorney, Agent, or Firm* — Maceiko IP

(57) ABSTRACT

A water display is described having different layers that each include a geometric shape. Water is provided to and drained from the display to vary the height of the water between the layers of the display. As the water height increases or decreases from one layer to another, pools of water assuming the geometric shapes formed in a given layer appear. The geometric shapes formed in a given layer appear. The geometric pools of water transform shapes as the water is raised or lowered.

14 Claims, 9 Drawing Sheets

WATER DISPLAYS INCLUDING CHANGING POOLS

CROSS REFERENCE TO RELATED APPLICATION

The application claims the benefit of U.S. Provisional Application No. 61/739,295, filed Dec. 19, 2012, the contents of which are incorporated herein by reference.

FIELD OF THE INVENTION

The present invention relates generally to water displays, including a display that may create different visual appearances by changing the water level in the display.

BACKGROUND OF THE INVENTION

Various water displays such as fountains have existed for some time. As water displays have advanced over the years, they have included water nozzles, jets and other components to provide various types of water choreography and visual effects. As can be appreciated, these types of displays may involve a lot of moving parts that may in turn require extensive software programming to coordinate their movement. Such components and associated programming may be expensive.

Other existing water displays are static. For example, a water display may simply involve a pool of water. However, such displays do not generate the same dramatic effect as the more dynamic type of display described above. Accordingly, there is a need for a water display that provides more visual features and dramatic effect but that does not necessarily require all the moving parts and associated programming required by other displays. This may be especially so at locations where a highly dynamic water display would not fit and/or otherwise be inappropriate.

SUMMARY OF THE INVENTION

In an aspect of the invention, a water display that provides dramatic visual effects is described. The display may include a pool that has different levels, and the visual effects may be provided by raising and lowering the height of the water between these different levels. For example, each level may be formed to include a number of geometric shapes, and each level may include different shapes. In this manner, as the water is lowered or raised from one level to the next, different geometric shapes may be displayed. That is, as the height of the water changes to different levels, the water may form pools of water that assume the shape of the geometric shapes residing at that particular level.

In another aspect of the invention, dramatic visual effects are provided without numerous components such as jets and moving nozzles, nor the programming associated with coordinating these components, that may all result in significant cost to design and install the display. However, the display of the current invention still provides significantly more dramatic effect than static or mostly static water displays.

In another aspect of the invention, the display may combine the different geometric pools of water with other water display effects as discussed herein. The foregoing and other aspects of the invention are described below.

DETAILED DESCRIPTION OF THE PREFERRED EMBODIMENTS

Figure 1:
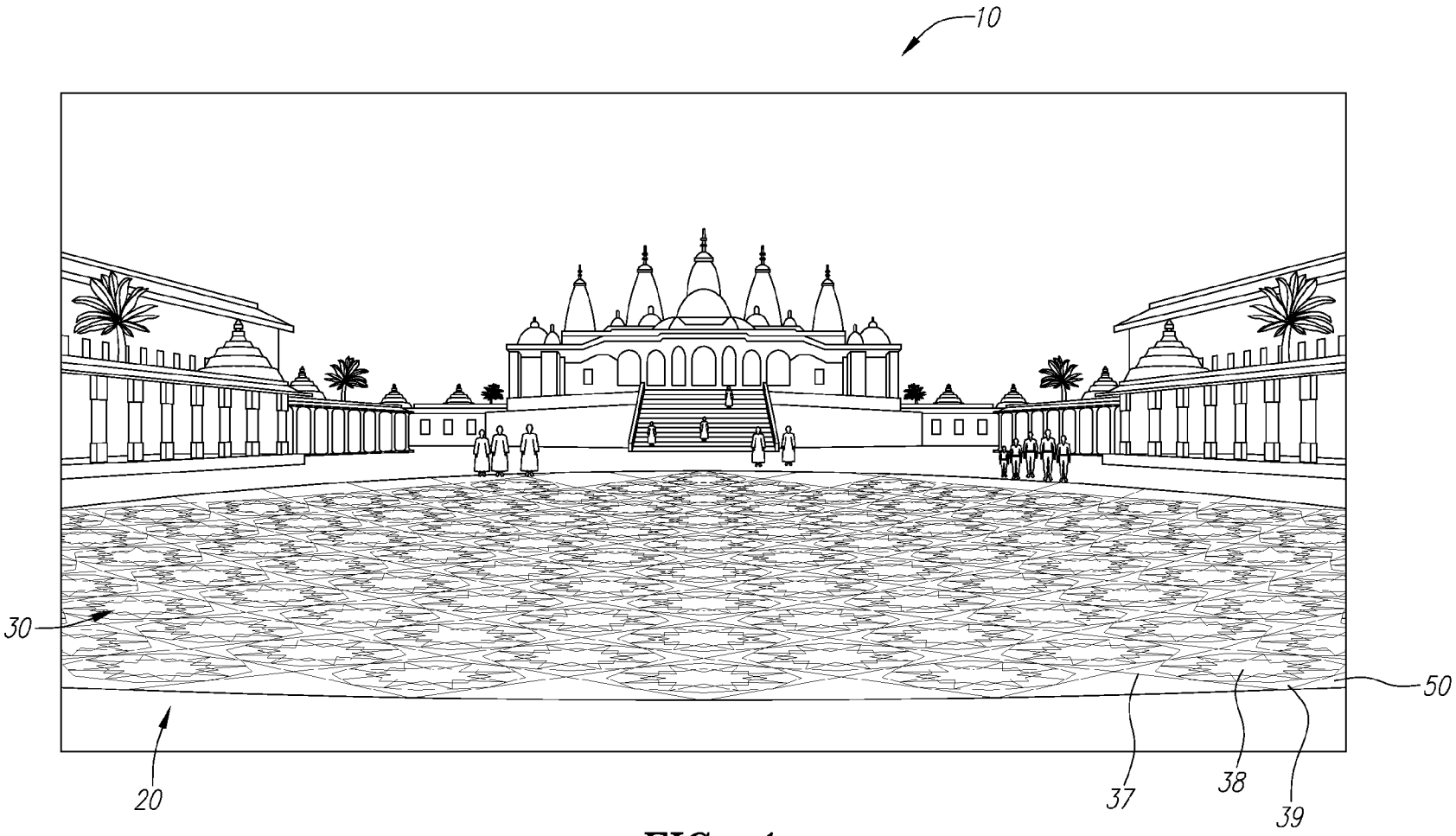
FIG. 1 is a perspective view of a water display where the water is at a first height.

The current invention is now described with reference to the figures. Components appearing in more than one figure bear the same reference numerals. The water display 10 is generally shown in FIGS. 1-4. It should be noted that display 10 is discussed herein in connection with water. However, other liquids or combinations thereof may be used within the scope of the current invention. To this end, additives may be used to provide certain colors, textures or other effects to the water or other liquid used.

As shown, display 10 may generally reside in a plaza 20 but other settings may be used such as patios, porches or other locations. It should be noted that the buildings shown in the figures are for context purposes only and do not limit the scope of the invention. To this end, the configuration of display 10 may vary so that it complements its surroundings. For example, as discussed later, display 10 may reveal different geometric shapes depending on its water level. These geometric shapes may generally complement the surroundings of display 10 by, for example, being similar to the geometric shapes of the surrounding buildings.

Figure 6:
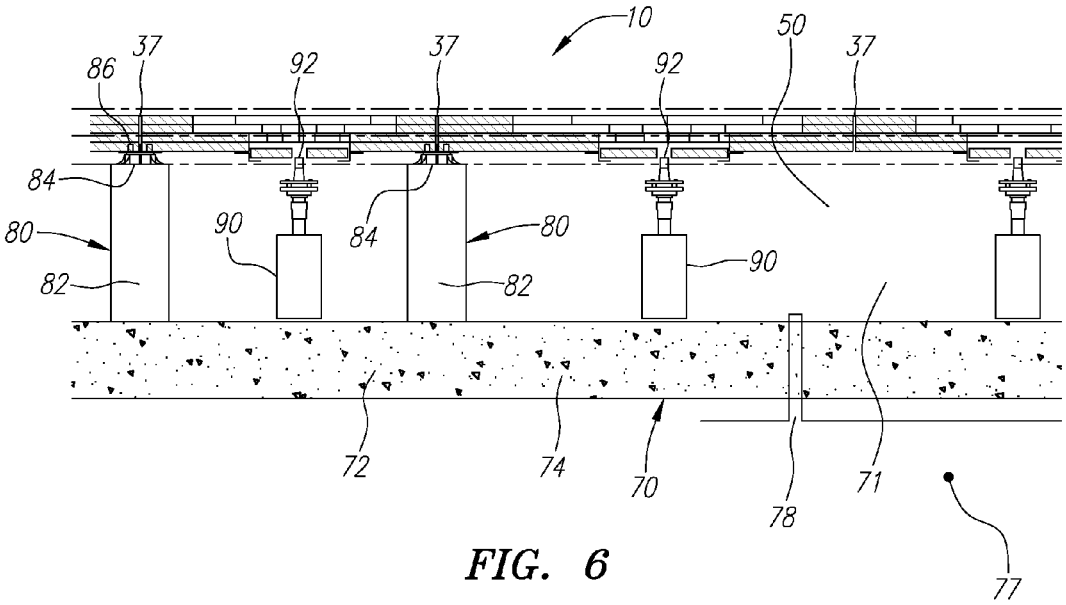
FIG. 6 is a cross-sectional view of a water display structure.
Figure 6A:
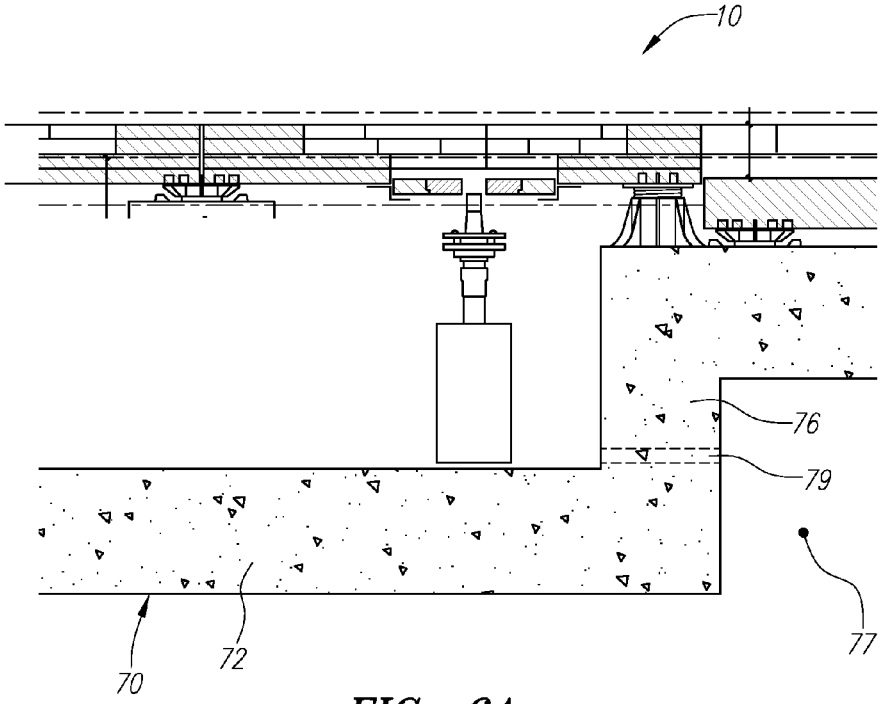
FIG. 6*a* is a cross-section view of a water display structure near its edge.

Display 10 generally comprises pool structure 30 which may contain water 50 at different levels 40. Though the number of levels may vary, display 10 may include levels 41, 42, 43, 44, 45, 46, 47 as described herein. Pool structure 30 may generally contain water or some other liquid 50, or combination thereof. Pool structure 30 may include different layers 31, 32, 33, 34, 35 to contain water 50 at these different levels 40. As discussed later, and as shown in FIGS. 6 and 6A, pool structure 30 may generally reside over basin 70 that may form a reservoir 71 that contains water or some other liquid 50. Reservoir 71 may drain into and may be fed by another reservoir that may be below and/or generally surround pool 70 and/or display 10.

Figure 3:
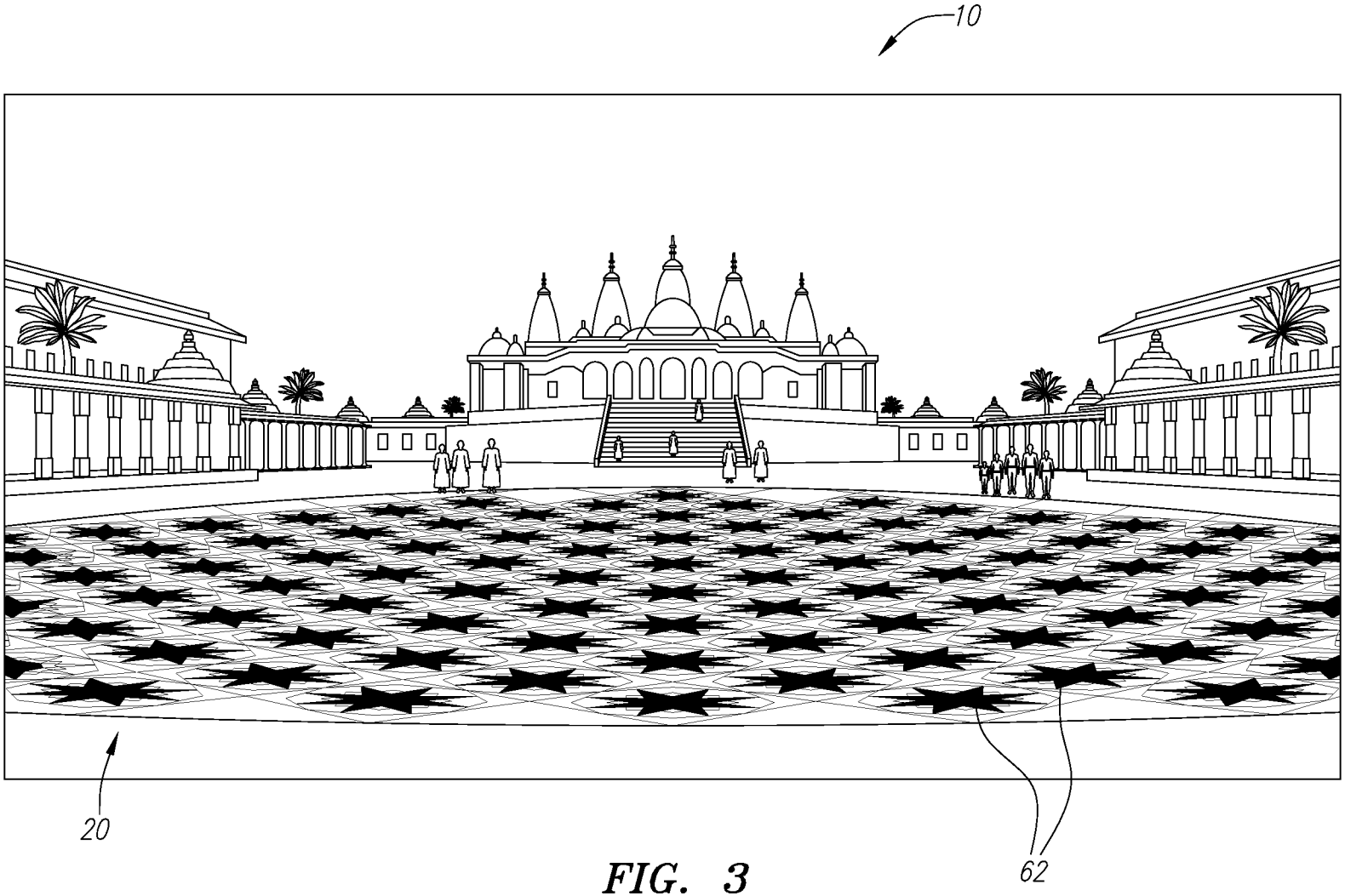
FIG. 3 is a perspective view of the water display where the water is at a third height.
Figure 4:
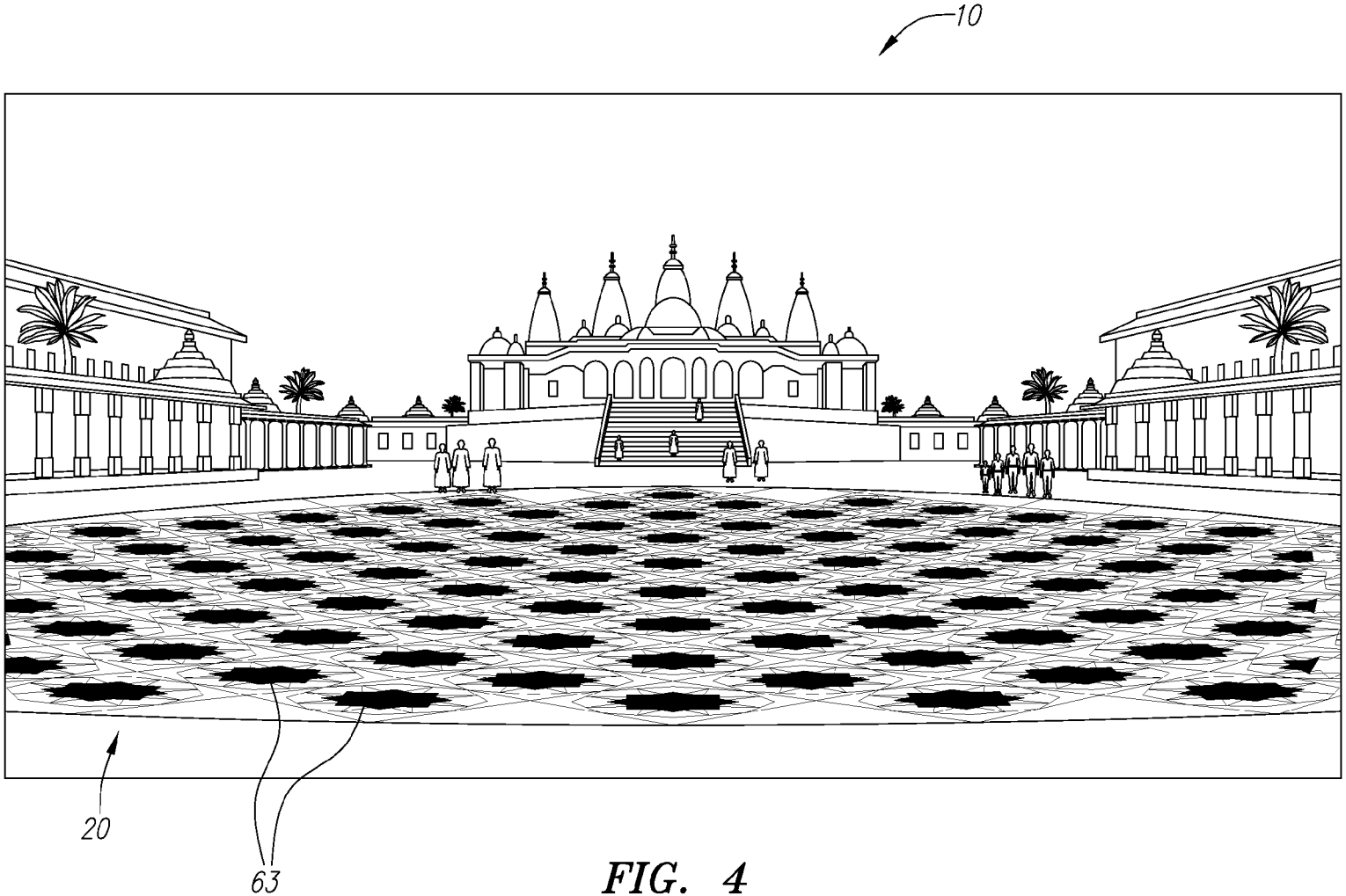
FIG. 4 is a perspective view of the water display where the water is at a fourth height.
Figure 5:
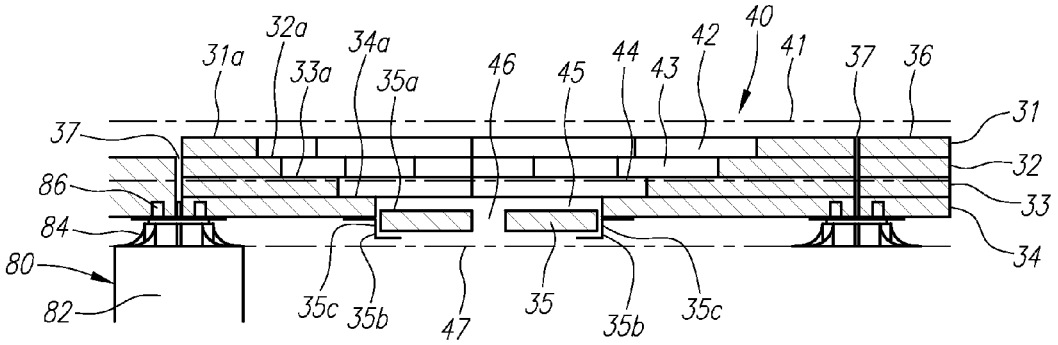
FIG. 5 is a cross-sectional view of a water display structure.

Display 10 may provide visual effects by raising and/or lowering the water 50 to different levels 40 and the manner in which this may occur is now further described with respect to FIGS. 1-4 and 5. As shown, FIGS. 1-4 show the overall display 10, as it may be seen by observers, at different water levels. FIG. 5 is a cross-sectional view of display 10 which shows the water at different heights with respect to the structure of display 10.

FIG. 1 generally shows how display 10 may look with the water at a full pool level 41. When filled to this level, the level of water 50 is preferably higher than the top surface 36 of pool structure 30. When filled in this manner, the entire pool structure 30 (or parts thereof) may be submerged. To this end, full pool level 41 may correspond to the level of the surrounding plaza 20 or other location at which display 10 is installed. In this embodiment, a smooth contiguous appearance between the material comprising plaza 20 and the surface of water 50 may be achieved. Alternatively, full pool level 41 may be at a different height than plaza 20. This may provide an offset appearance between display 10 and plaza 20.

As noted above, display 10 may display different geometric shapes 60 whose shape may vary depending on the water level. In the description below, shapes 60 generally refers to the geometric shapes in general while specific shapes are later referenced as octagon 61, star 62, etc.

When filled to full pool level 41, geometric shapes 60 may be submerged, but their outlines may still be visible under water 50 as shown. Pool structure 30 may also comprise sections 38, 39 whose outlines 37 may also be visible under water 50. As discussed in more detail below, certain sections 38 may comprise the different geometric shapes 60 to be displayed, while other sections 39 may reside at the perimeter of pool 30 so as to form a transition between display 10 and plaza 20. Lines 37 may generally represent a gap between each of sections 38, 39. In sum, when filled to full pool level 41, display 10 may generally appear as a pool of water as shown in FIGS. 1 and 5.

Figure 2:
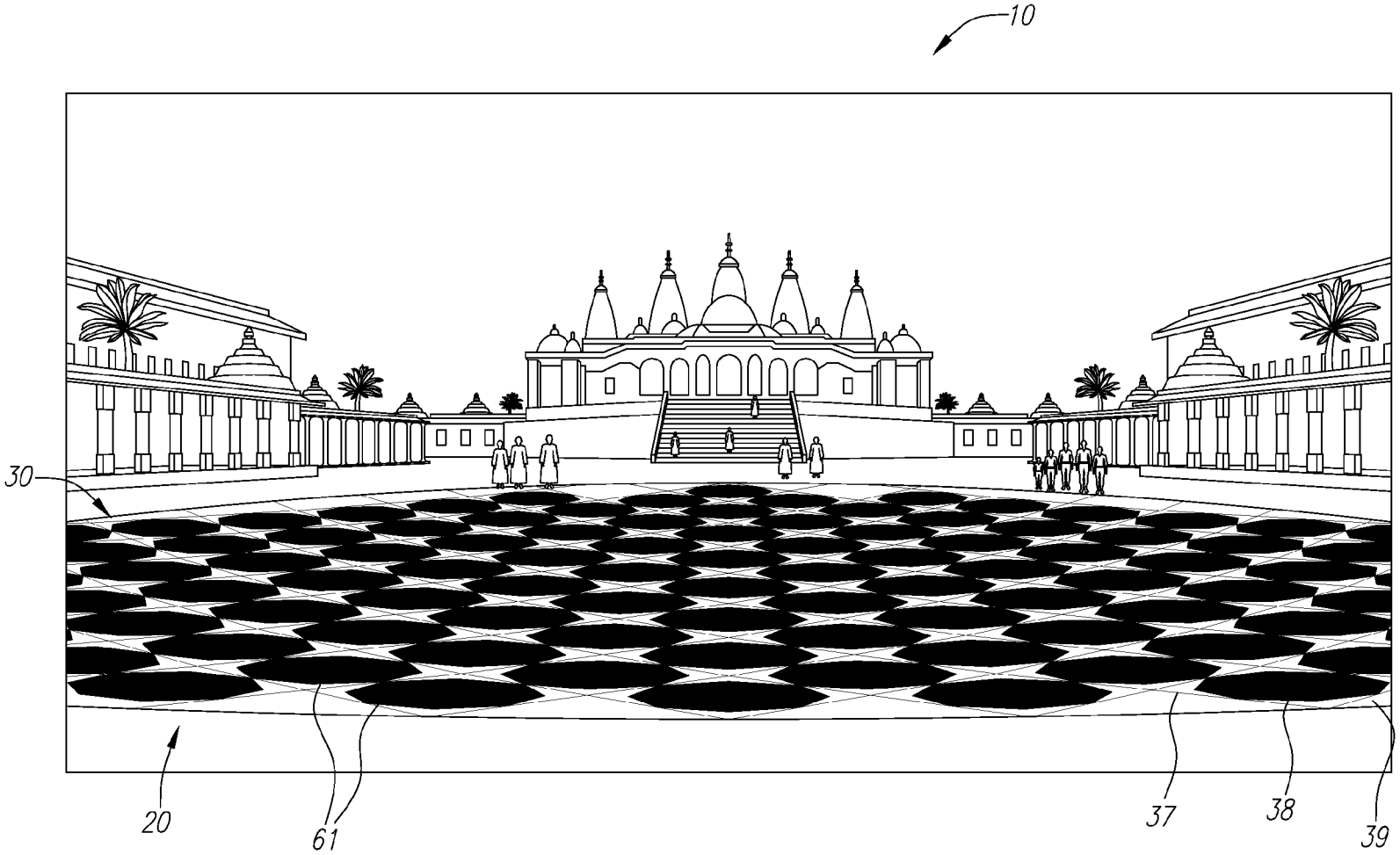
FIG. 2 is a perspective view of the water display where the water is at a second height.

As shown in FIGS. 2 and 5, the height of water 50 may be lowered to reveal a first set of geometric shapes 61. At this point, the height of the water 50 may be at level 42 which may be at or slightly below the top surface 36 of pool 30 (or at or slightly bellow the top surface 31*a* of first layer 31) as shown more clearly in FIG. 5. At this level, the first or top layer 31 of pool 30 may generally be exposed and separate pools of water that assume the geometric shape(s) of that level appear.

More specifically, each section 38 of layer 31 may be formed to have a perimeter corresponding to the geometric shape 61. Accordingly, when the top of layer 31 is exposed above water 50, geometric shape 61 is displayed as a separate pool of water in each section 38.

As shown, the pools of water in the form of shape 61 may be separated from each other by top surface 31*a*, 36. In the embodiment of FIG. 2, shape 61 comprises an octagon, but other shapes may be used. Each shape 61 may be the same or similar to each other, but different shapes may also be used for a given water level.

As shown in FIGS. 3 and 5, the height of the water 50 may be further lowered to reveal a second set of geometric shapes 62. At this point, the height of the water 50 may be at level 43 which may be at or slightly below the top surface 32*a* of second layer 32. At this level, the first or top layer 31, as well as the second layer 32, may generally be exposed and separate pools of water that assume the geometric shape(s) of that level appear.

More specifically, each section 38 of layer 32 may be formed to have a perimeter of the geometric shape 62. Accordingly, when the top of layer 32 is exposed above water 50, that geometric shape 62 is displayed as a separate pool of water in each section 38.

As shown, the pools of water in the form of shape 62 may be separated by the various surfaces that have now been exposed. In the embodiment of FIG. 3, shape 62 comprises a star, but other shapes may be used. Each shape 62 may be the same or similar to each other, but different shapes in this level may also be used.

As discussed further below, in a preferred embodiment, the perimeter of shape 62 is generally within the perimeter of shape 61 above it. This is preferable so that the outline of the pool of water in the form of shape 62 may be readily seen. If shape 62 were generally larger than shape 61, its outline in layer 32 would be hidden below the outline of shape 61 in layer 31. However, the perimeters of shapes 61, 62 may coincide at various points.

As shown in FIGS. 4 and 5, the height of the water 50 may be further lowered to reveal a third set of geometric shapes 63. At this point, the height of the water 50 may be at level 44 which may be at or slightly below the top surface 33*a* of third layer 33. At this level, layers 31, 32, as well as layer 33 may generally be exposed and separate pools of water that assume the geometric shape(s) of that level appear.

More specifically, each section 38 of layer 33 may be formed to have a perimeter of the geometric shape 63. Accordingly, when the top of layer 33 is exposed above water 50, that geometric shape 63 is displayed as a separate pool of water in each section 38.

As shown, the pools of water in the form of shape 63 may be separated by the various surfaces that have now been exposed. In the embodiment of FIG. 4, shape 63 appears as a square with points on each side, but other shapes may be used. Each shape 64 may be the same or similar to each other, but different shapes in this level may also be used.

The perimeter of shape 63 is generally within the perimeter of shape 62 above it. This is preferable so that the outline of the pool of water in the form of shape 63 may be readily seen. If shape 63 were generally larger than shape 62, its outline in layer 33 would be hidden below the outline of shape 62 in layer 32. However, the perimeters of shapes 62, 63 may coincide at various points. The perimeters of shapes 62, 63 may also coincide with the perimeter of shapes 61 at various points as well.

Figure 8:
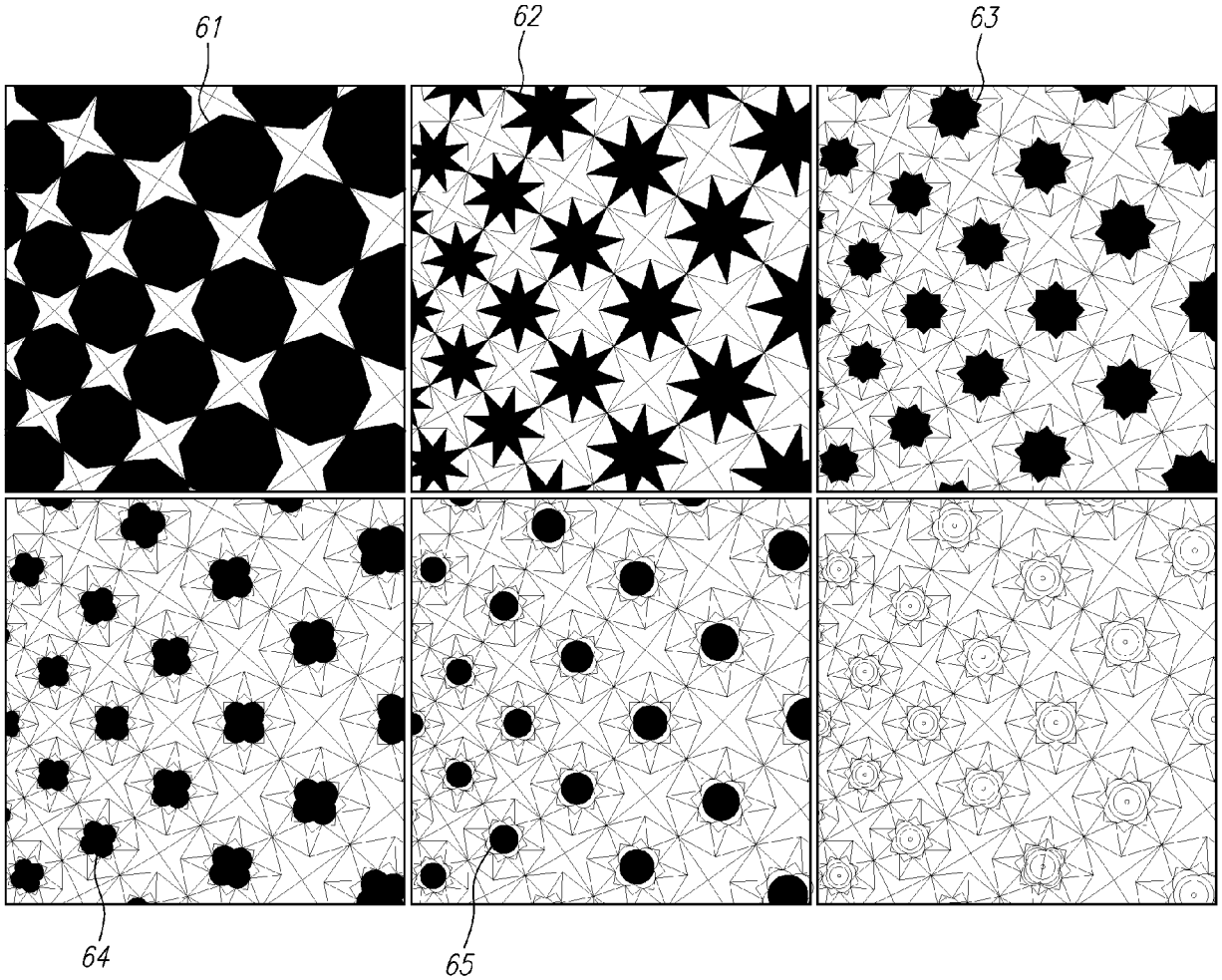
FIG. 8 shows a series of geometric shapes that may appear in a water display.

Referring to FIGS. 5 and 8, pools of water having additional geometric shapes 60 that may be displayed as different layers 30 are exposed are now discussed. FIG. 8 shows a top view of display 10 where the water level resides at different levels 40, thereby showing the different shapes 60. Starting from the upper left corner, octagon 61, star 62 and square (with points) 63 that were discussed above are shown. The second row of FIG. 8 shows shapes 64, 65 which may be displayed as the water level is lowered further. The lower right corner of FIG. 8 shows what display 10 may look like with water 50 drained below the bottom level 35.

The additional shapes 64, 65 are now described with reference to FIG. 5. The height of the water 50 may be further lowered to reveal a fourth set of geometric shapes 64. At this point, the height of the water 50 may be at level 45 which may be at or slightly below the top surface 34*a* of fourth layer 34. At this water level, layers 31, 32, 33, as well as layer 34, may generally be exposed and separate pools of water that assume the geometric shape(s) of that level appear.

More specifically, each section 38 of layer 34 may be formed to have a perimeter of the geometric shape 64. Accordingly, when the top of layer 34 is exposed above water 50, that geometric shape 64 is displayed as a separate pool of water in each section 38.

As shown, the pools of water in the form of shape 64 may be separated by the various surfaces that have now been exposed. Similar to shapes 61, 62, 63 discussed above, shape 64 may resemble various shapes and the perimeter of shape 64 is generally within the perimeter of shapes 61, 62, 63 above it, though its perimeter may coincide with various points of the shapes above it.

The height of the water 50 may be further lowered to reveal a fifth set of geometric shapes 65. At this point, the height of the water 50 may be at level 46 which may be at or slightly below the top surface 35*a* of fifth layer 35. At this water level, layers 31, 32, 33, 34, as well as layer 35, may generally be exposed and separate pools of water that assume the geometric shape(s) of that level appear.

More specifically, each section 38 of layer 35 may be formed to have a perimeter of the geometric shape 65. Accordingly, when the top of layer 35 is exposed above water 50, that geometric shape 65 is displayed as a separate pool of water in each section 38.

As shown, the pools of water in the form of shape 65 may be separated by the various surfaces that have now been exposed. Similar to shapes 61, 62, 63, 64 discussed above, shape 65 may resemble various shapes and the perimeter of shape 65 is generally within the perimeter of shapes 61, 62, 63, 64 above it, though its perimeter may coincide with various points of the shapes above it.

Shape 65 may also generally serve as a drain for each section 38 since it may reflect the hole in the bottommost layer 35. To this end, the height of the water 50 may be further lowered so that the top view of pool 30 is generally drained and looks as shown in the lower right corner of FIG. 8. At this point, the height of the water 50 may be at level 47 which may be below the bottom or fifth layer 35.

Figure 9:
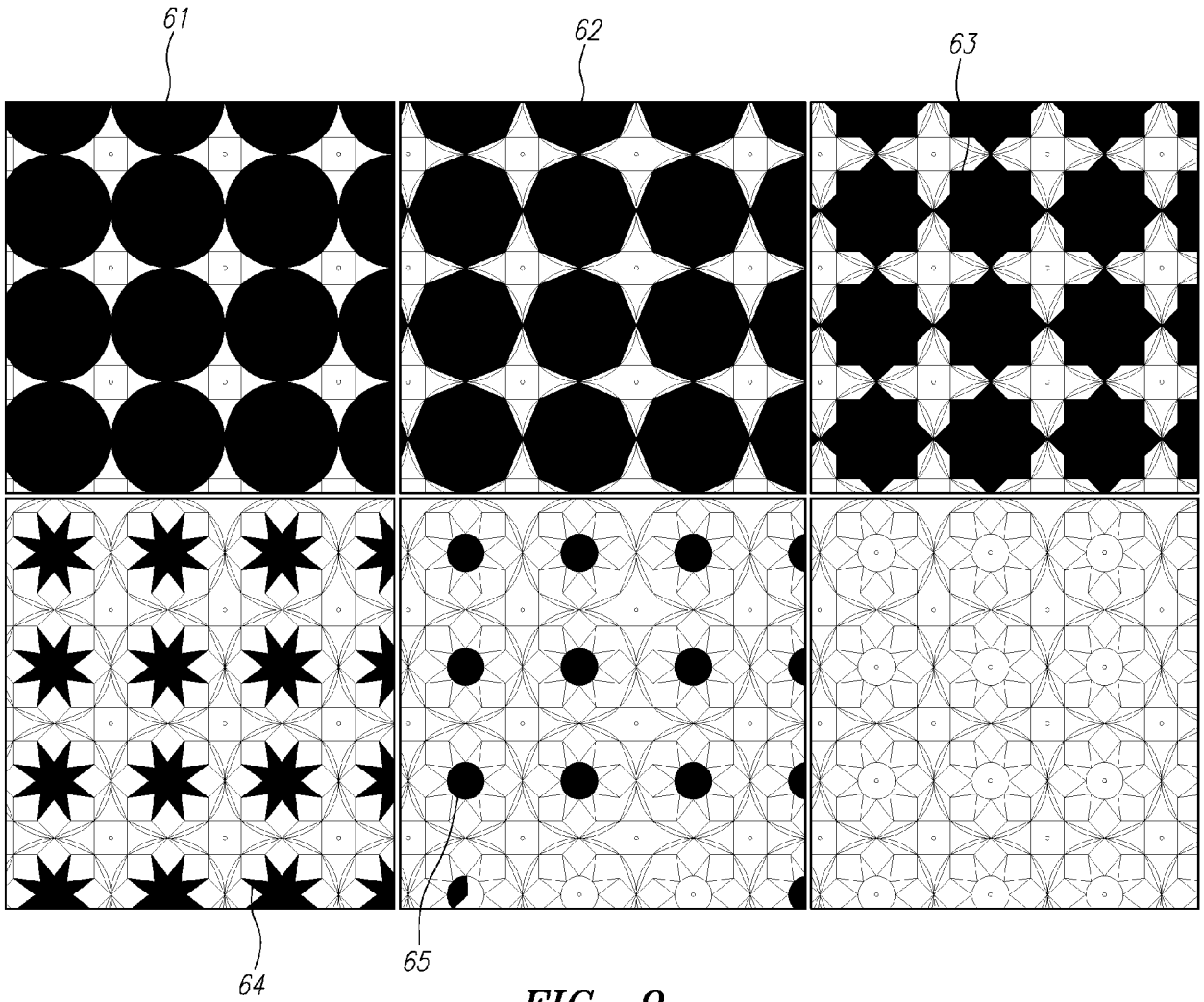
FIG. 9 shows an alternate series of geometric shapes that may appear in a water display.

It should be noted that the number of levels 40 and thus the number of shapes 60 that may be shown by display 10 may vary. And as noted above, the shapes 60 on a given level 40 may vary. Accordingly, the invention is not limited to the embodiment described in FIGS. 1-4, 5 and 8. For example, FIG. 9 shows different geometric shapes 60 that may be formed in the different levels 40. Other alternative shapes may be used within the scope of the invention.

The height of the water of each level may also vary. While the foregoing description discusses water levels 40 being slightly below the top surface of a given layer 30, the water level 40 may be right at the top surface or further below it.

The construction of display 10 is now further described with reference to FIGS. 5, 6, 6A and 7. As shown in the cross-sectional views of FIGS. 5, 6 and 6A, and as discussed above, display 10 may include a pool structure 30 that includes several layers 31, 32, 33, 34, 35. The layers comprising pool structure 30 may be formed of stone or some other suitable material. Any material that may be formed to contain pools of water in a geometric shape or other design may be used within the scope of the invention.

The various layers 31, 32, 33, 34, 35 comprising pool structure 30 may be individually formed by creating the pertinent geometric form 60 in each layer and then joining the layers together. Alternatively, the layers may be contiguous to each other and the pertinent geometric forms 61, 62, 63, 64, 65 be formed sequentially from the topmost layer 31 to the bottommost layer 35.

In any event, in a preferred embodiment, the layers 30 may generally have less material cut out from them as they descend. That is, layer 31 will have less material remaining than layer 32 after their respective geometric shapes 60 are cut out. This allows the lower layers support the layers above them and also provides for displaying successive pools of water as the water height is lowered.

As shown in FIGS. 5, 6 and 6A, the bottommost layer 35 may be attached to the next layer 34 by flanges 35*b*. As shown, lateral gaps 35*c* may exist between layers 34, 35. This allows some amount of lateral movement of bottommost layer 35 which may aid in corresponding the location of geometric shape 65 formed in layer 35 to the location of the nozzles 92 as further discussed below. Shape 65 may also serve as a conduit between the layers 30 above and reservoir 71 below.

As indicated above, pool structure 30 may comprise sections 38 which contain geometric forms 60, and sections 39 which form the transition between display 10 and plaza 20. These separate sections may be located and/or joined together to form the overall pool structure 30 as shown in FIGS. 1-4. Pool structure 30 preferably comprises separate sections 38, 39 to ease the installation of display 10. That is, if pool structure 30 comprised one contiguous structure across the entire display 10, and if display 10 had overall dimensions on the order shown in FIGS. 1-4, display 10 would be very difficult to install. Furthermore, the separate nature of sections 38, 39 also allows for thermal expansion or contraction in the spaces 37 that may exist between the sections.

However, the scope of the invention also includes smaller displays 10 that may only comprise several such sections 38 or even one such section 38. In such smaller displays 10, pool structure 30 may indeed comprise one contiguous structure.

Figure 7:
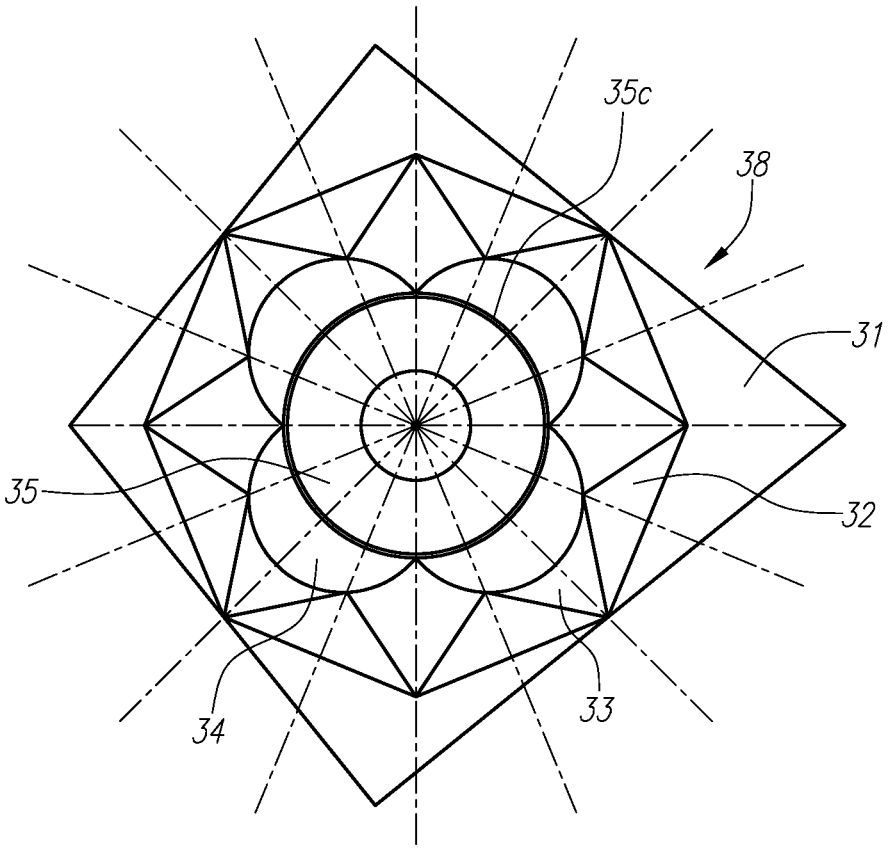
FIG. 7 is a top view of a section of a water display structure.

FIG. 7 shows an example of a section 38 from a top view. As shown, section 38 may include layers 31, 32, 33, 34, 35. FIG. 7 shows how the perimeters of the geometric shapes on lower layers are generally within the perimeters of the geometric shapes on higher layers. FIG. 7 also shows how the perimeters of the different layers may coincide at various points.

The interaction of pool structure with the rest of display 10 is now further described. As shown in FIGS. 6 and 6A, pool structure 30 may generally reside over a basin 70 that includes reservoir 71 of water or some other liquid 50. Basin 70 may include a foundation 72 that serves to form reservoir 71. To this end, foundation 72 may generally include bottom 74 and sides 76. The shape of foundation 72 may vary within the scope of the invention. Basin foundation 72 may be made of concrete or any other suitable material that may contain water or some other liquid 50.

Pool structure 30 may be supported over reservoir 71 by a series of piers 80. Piers 80 may include columns 82 and attachment members 84. Columns 82 may comprise concrete, metal or other material that is strong enough to support the weight of pool structure 30. Columns 82 may be attached to foundation bottom 72 by any suitable means. Alternatively, columns 82 may simply rest on the foundation bottom 72 and held in place by its own weight as well as the weight of pool structure 30. In locations where earthquakes may occur, it is preferred that columns 82 be attached to foundation bottom 72 and/or foundation side 74.

An attachment member 84 may be attached to the top of column 82. Attachment member 84 may serve to engage consecutive sections 38 as shown. Sections 38 may be attached to member 84 by bolts 86 or other suitable attachment means. Section 38 may be positioned on top of piers 80 so that gaps or lines 37 exist between them as noted above. Gaps 37 may provide room for tolerance for dimensional error as display 10 is installed.

Piers 80 may also support transitional sections 39. Furthermore, the outermost perimeter of transitional sections 39 or certain sections 38 may be supported by the walls 76 of foundation 72.

Display 10 may include additional water and/or visual effects beyond the pools of water in geometric shapes that are displayed as the height of water 50 varies. For example, display 10 may also include devices 90 that may shoot water up into the air in various configurations. An example of this is the water canopy described in U.S. patent application Ser. No. 61/739,667, the disclosure of which is incorporated hereto by reference in its entirety. Each device 90 may include nozzle 92 that may actually deliver water 50. As mentioned earlier, the positions of shapes/drains 65 may be adjusted to match the locations of nozzles 92.

The operation of display 10 is now further described. As mentioned earlier, display 10 may show pools having different geometric shapes 60 or other designs by varying the level of water or other liquid 50. The different water levels may be attained by raising the water level using pumps and lowering the water level by gravity powered drains.

It should be noted, however, that different systems may be used to deliver and remove water and the current invention is not limited to the use of pumps and gravity powered drains. Accordingly, the scope of the invention is not limited to the above-described water delivery and removal system.

For purposes of example only, a system to deliver and drain water 50 may be as follows. Reservoir 71 may be fed by, and may drain into, an auxiliary reservoir 77 that is located below reservoir 71, and that is preferably not visible to the observer. Auxiliary reservoir 77 is shown as a volume in FIGS. 6 and 6A only for general purposes and the invention is not limited to the embodiment shown.

Water may be pumped from auxiliary reservoir 77 to reservoir 71 thereby raising the height of water 50. This may occur through pumps (not shown) which may pump water up through foundation bottom 72 via inlet pipes 78. Inlet pipes 78 may stick up above foundation bottom 72 but are preferably not visible to the observer. Inlet pipes 78 may also be fitted with vortex plates which preferably reduce any water jet effect they might otherwise display when water is pumped therethrough. This facilitates the smooth transition between different geometric pools of water.

With respect to draining, water 50 may generally drain through the descending geometric shapes through the hole (shape) or drain 65 in the lowest layer 35. The water 50 may thus generally drain into reservoir 71 and then into auxiliary reservoir 77. Pool foundation 70 may include drains 79 near its bottom 72 which may be opened so that the water within the pool structure 30 may flow down to auxiliary reservoir 77 due to gravity. When enough water has been drained, the drains 79 in pool bottom 72 may be shut. At this point, water from the auxiliary water reservoir 77 may be fed by through inlets 78 by pumps which may serve to raise the water level.

Beyond devices 90 described above, display 10 may also include various accessories. For example, lighting (not shown) may be contained under pool structure 30 which may illuminate different colors or lighting effects, e.g., flashing, depending on the water level. In this manner, certain colors may be associated with certain geometric shapes. As another example, fountains, water jets or water nozzles may also be included. In this manner, water 50 may be ejected from nozzles 92 with sufficient force that a number of fountains appear when display 10 receives water 50.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A water display, comprising:

a reservoir that contains water;

a plurality of layers that are located over the reservoir, wherein each layer includes a plurality of geometric shapes that are separated from each other and that define areas that are separate from each other;

a system to raise and lower water to and from the reservoir to vary the height of the water; and a plurality of pools of water that are contained in the areas, that are separate from each other, and that have geometric shapes displayed according to the height of the water.

2. The water display of claim 1, wherein the system to raise and lower water includes nozzles or inlet pipes and gravity drains.

3. The water display of claim 1, wherein the plurality of layers includes a plurality of horizontally adjacent sections.

4. The water display of claim 3, wherein the geometric shape sections are surrounded by a plurality of transitional sections.

5. The water display of claim 1, wherein the geometric shape included in a lower layer is smaller than the geometric shape included in a higher layer.

6. The water display of claim 1, wherein water drains through the geometric shapes of the layers.

7. A water display, comprising:

a pool structure capable of holding water and comprising:

at least one geometric shape section that is supported over the water and that includes a vertical stack of layers each having a vertical thickness and horizontally defining an internal open region having a geometric shape, wherein the geometric shape of the internal open region of each layer differs from that of the internal open region of any other layer to which it is vertically adjacent; and a system to raise and over the water into and out of the at least one geometric shape section so that the height of water held by the at least one geometric shape section can be selected to fall within the height of any of the layers.

8. The water display of claim 7, wherein the water display includes a plurality of geometric shape sections.

9. The water display of claim 8, wherein the plurality of geometric shape sections are horizontally adjacent.

10. The water display of claim 8, wherein the pool structure further includes a transition section adjoining a region external to the water display.

11. The water display of claim 7, wherein the system to raise and lower the water includes an inlet pipe.

12. The water display of claim 7, wherein the system to raise and lower the water includes a drain.

13. The water display of claim 7, wherein the pool structure further comprises a nozzle capable of shooting water above the pool structure.

14. The water display of claim 7, wherein the internal open region of a layer is smaller than that of another layer above it.

* * * * *